US011547629B2

(12) United States Patent
Phreaner

(10) Patent No.: US 11,547,629 B2
(45) Date of Patent: Jan. 10, 2023

(54) ENTERAL BAG SYSTEM FOR NUTRITIONAL COMPOSITION

(71) Applicant: Kate Farms, Inc., Santa Barbara, CA (US)

(72) Inventor: Christina Phreaner, Santa Barbara, CA (US)

(73) Assignee: Kate Farms, Inc., Santa Barbara, CA (US)

( * ) Notice: Subject to any disclaimer, the term of this patent is extended or adjusted under 35 U.S.C. 154(b) by 0 days.

(21) Appl. No.: 17/236,177

(22) Filed: Apr. 21, 2021

(65) Prior Publication Data

US 2022/0339066 A1 Oct. 27, 2022

(51) Int. Cl.
*A61J 1/10* (2006.01)
*A61J 1/14* (2006.01)

(52) U.S. Cl.
CPC ..... *A61J 1/10* (2013.01); *A61J 1/1412* (2013.01)

(58) Field of Classification Search
CPC .... A61J 1/10; A61J 1/1412; A61J 1/20; A61J 1/1416; A61J 1/1475
See application file for complete search history.

(56) References Cited

U.S. PATENT DOCUMENTS 3,030,955 A * 4/1962 Gossett ..... A61J 1/10 604/404
3,642,047 A * 2/1972 Waage ..... A61J 1/10 604/408
4,326,574 A * 4/1982 Pallaroni ..... B32B 27/34 604/415
4,542,530 A * 9/1985 Thomas ..... B65D 75/5877 53/503
4,578,074 A * 3/1986 van Leerdam ..... A61J 1/10 604/408
4,840,017 A * 6/1989 Miller ..... A61J 1/05 53/468
4,869,725 A 9/1989 Schneider et al.
5,137,527 A * 8/1992 Miller ..... A61J 1/10 215/247
6,039,718 A * 3/2000 Niedospial, Jr. ..... A61J 1/10 604/408
7,950,547 B2 * 5/2011 Saunders ..... B67D 1/0804 222/64
8,007,174 B2 * 8/2011 Yamaguchi ..... B65D 33/2525 383/9
8,056,510 B2 * 11/2011 Handley ..... A01K 1/031 119/72
9,925,120 B2 3/2018 Kropczynski et al.
2006/0282061 A1 * 12/2006 Domkowski ..... A61J 1/10 604/408

(Continued)

FOREIGN PATENT DOCUMENTS

WO WO 2005/089697 A1 9/2005

OTHER PUBLICATIONS

Anonymous, "Frequently Asked Questions About Medical Foods; Second Edition," U. S. Department of Health and Human Services, 1-12 (2016).

(Continued)

*Primary Examiner* — Timothy L Maust
(74) *Attorney, Agent, or Firm* — HoustonHogle LLP

(57) ABSTRACT

An enteral bag system constructed of two welded panels.

6 Claims, 2 Drawing Sheets

(56) References Cited

U.S. PATENT DOCUMENTS

| | | | | |
|---|---|---|---|---|
| 2010/0249728 | A1* | 9/2010 | Kobashi | A61J 1/10 604/262 |
| 2013/0102990 | A1* | 4/2013 | Domkowski | B65B 3/003 604/416 |
| 2016/0051444 | A1* | 2/2016 | Muth | B31B 50/64 604/408 |

OTHER PUBLICATIONS

Anonymous, "Enteral Feeding Systems—Design and Testing," International Standard, 1-44 (2020).

* cited by examiner

ENTERAL BAG SYSTEM FOR NUTRITIONAL COMPOSITION

BACKGROUND OF THE INVENTION

Patients often require the delivery of nutritional compositions when they cannot orally ingest food. Commonly delivery tubes are used to deposit the compositions directly into the gastrointestinal tract at a point below the mouth.

The nutritional compositions are typically stored in feeding containers. Rigid containers, such as plastic bottles are common. Flexible bags, however, have advantages. They can collapse as the compositions are being administered, reducing the need to allow for air inflow during administration. In addition, bags can be less expensive.

SUMMARY OF THE INVENTION

On the other hand, bags can also be problematic. It can be difficult to extract all of the nutritional composition during administration. In addition, careful design is required of the bag connector fitment especially when using spike connector systems to ensure that the bag is not damaged when connecting the spike connector to the bag connector fitment.

This invention relates to apparatus for administering fluids, such as enteric nutritional compositions to patients in hospitals, nursing homes and the like. More particularly, this invention concerns a sealed flexible bag system for holding and storing such enteric nutritional compositions before and during such feeding procedures.

The enteral feeding bag of this invention is preferably formed of flexible plastic of a transparent or translucent quality. It is readily attached to a hanger bracket or hook support. A delivery tube may be attached to the bag connector fitment.

In general, according to one aspect, the invention features an enteral bag system comprising front and rear panels which are welded to each other by bottom and top welds and two oblique welds on each opposed side.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
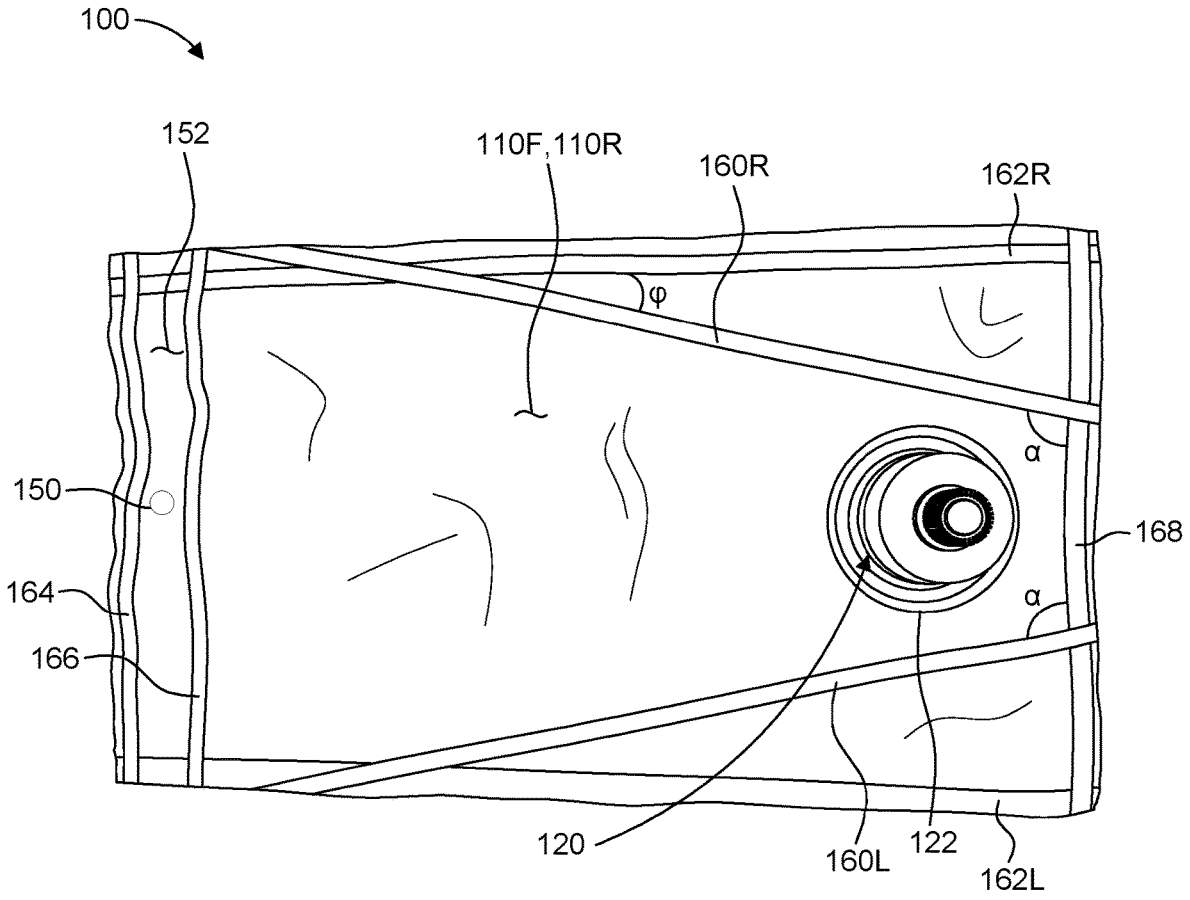
FIG. 1 is a front elevation view of the bag system of the invention in an unfilled condition.

FIG. 1 shows an enteral bag system 100 that has been constructed according to the principles of the present invention.

The enteral bag system is currently constructed of separate front and rear panels 110F and 110R, with the front panel 110F arranged on the rear panel 110R. These are flexible multi ply plastic film panels that can be constructed from materials such as polyvinyl chloride, polyethylene, polypropylene or the like film. Currently, each panel includes inner ply of ethylene-vinyl alcohol copolymer (EVOH) and outer ply of polyethylene terephthalate (PET) and aluminum oxide, which are laminated together.

The front and rear panels 110F and 110R are secured to each other at their edges thereof by heat sealing, cementing or the like. In the current example, the outer perimeters of the panels are secured to each other by left weld 162L, a right weld 162R, a subpanel weld 164, and a bottom weld 168.

A top weld 166 extends laterally across the bag below and parallel to the subpanel weld 164. The top weld defines the top extent of the volumetric region for containing the nutritional composition.

Subpanel weld 164 and the top weld 166, along with the upper portions of the left weld 162L and right weld 162R, demarcate a top subpanel region 152 in which an aperture or hanging hole 150 is formed. This hole 150 can be formed by die-punching and is for accepting a hook or hanger bracket. In this way, the subpanel weld 164 functions to strengthen the bag system to hold the contained nutritional composition without tearing. The top weld 166 ensures that the volumetric region containing the nutritional composition between the front panel 110F arranged on the rear panel 110R is not breached even with slight tearing due to the force of the hook pulling against the portions of the subpanel 152 surrounding hanging hold 150.

A left oblique weld 160L and a right oblique weld 160R define the volumetric region containing the nutritional composition on lower portions of the left and right sides. In the current embodiment, the left oblique weld 160L and the right oblique weld 160R run from the top portions of the left edge weld 162L and the right edge weld 162R, respectively, to the bottom weld 168 at an approximately ⅓ the length of the weld from either side. This gives the volumetric region a generally frusto-conical shape when filled.

Base angle α is the internal angle between the bottom weld 168 and the lower ends of each of the oblique welds 160L, 160R. Angle α is preferably between 100 degrees and 150 degrees. It is currently about 105 degrees and is ideally less than 135 degrees. The frusto-conical shaped volumetric region generally improves the bag system's operation by improving the evacuation of the nutritional composition during feeding. The angular relationships ensure better evacuation during use and minimizes the wasted composition that remains in the bag after use.

The following table shows evacuation testing for two bag designs. In one design, angle α was about 105 degrees and in another design angle α was about 140 degrees. The table shows that better evacuation was achieved when lower values for angle α were used.

| Package | Angle • ~105 | Angle • ~140 |
|---|---|---|
| Amount of Product in Package (ml) | 1103 | 1067 |
| Amount of Product Actually Dispensed (ml) | 1085 | 996 |
| Pump Reading (ml) | 1017 | 939 |
| Actual-Pump reading (ml) | 68 | 57 |
| Excess Product in Package (ml) | 18 | 71 |

A bag connector fitment 120 is located near the lower end of the bag system, between the lower end of the left oblique weld 160L and a right oblique weld 160R and just above the center of the bottom weld 168. The fitment 120 is sealed to the front panel 110F such as by welding or cement at seam 112. In the current embodiment, the fitment 120 includes a spike port for mating with a standard spike connector of a delivery tube maintained in the patient's nose and esophagus for administering feedings. Often a peristaltic pump is additionally used to control the flow of the nutritional composition.

Figure 2:
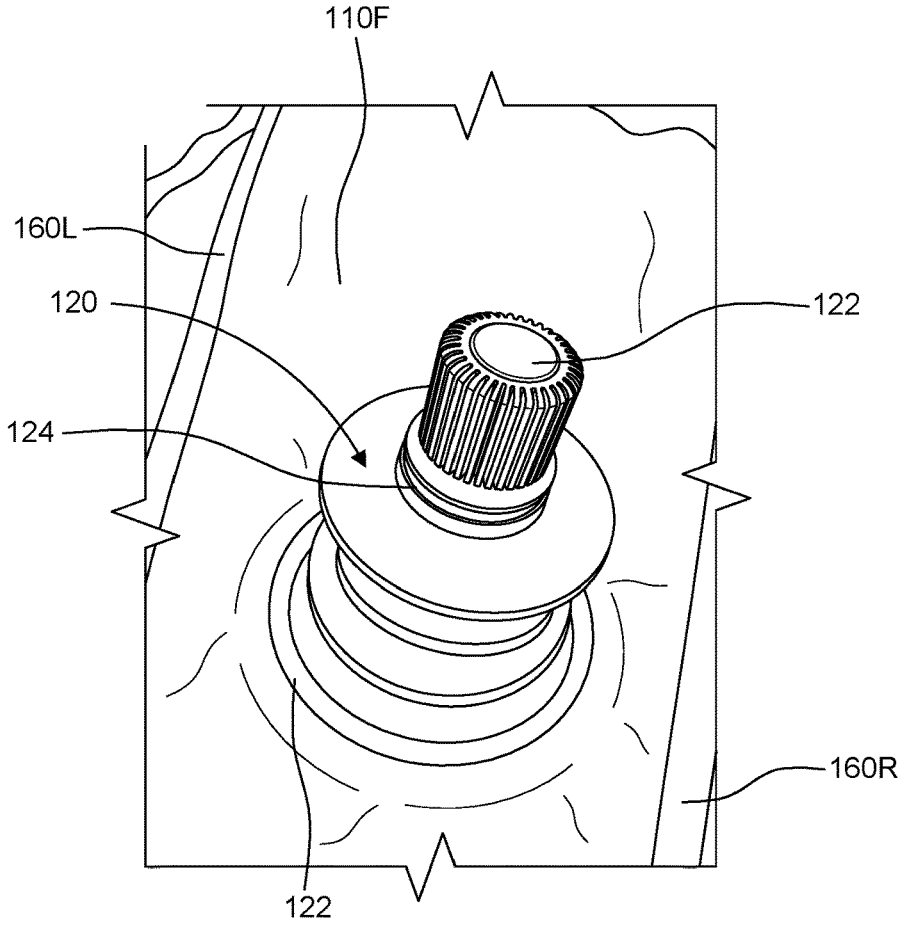
FIG. 2 is an enlarged partial view of the bag's connector fitment.
Figure 3:
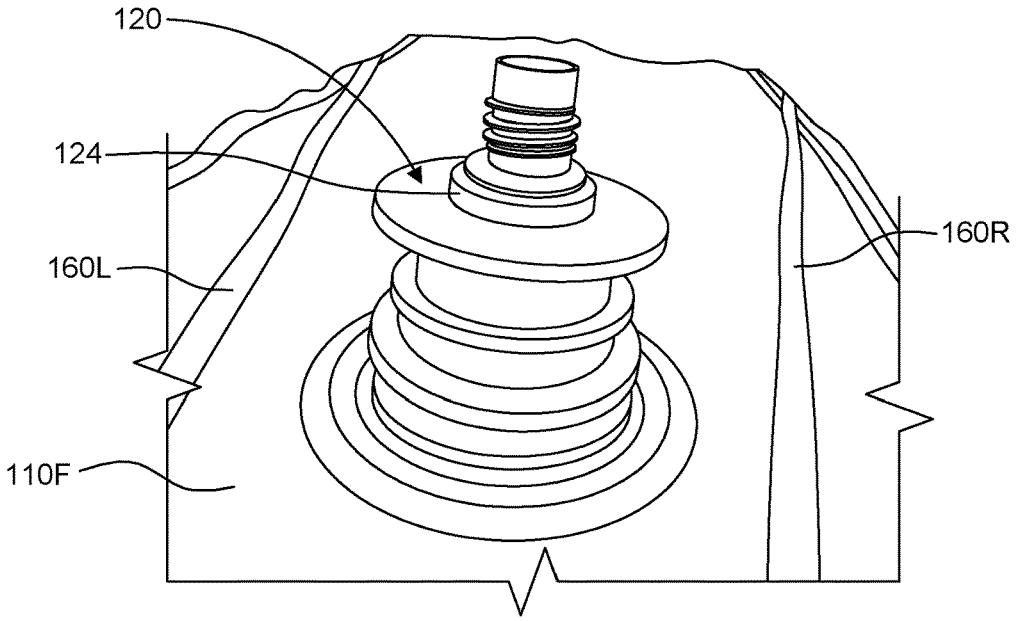
FIG. 3 is another enlarged partial view of the bag's connector fitment with the cap removed.

FIGS. 2 and 3 better show the fitment 120 with its cap 122 in place and removed respectively. When the cap 122 is removed, the connections to the cap's band 124 are broken to indicate that the cap has not been previously removed. Underneath the cap is the standard spike port as mandated by World Health Organization (WHO).

While this invention has been particularly shown and described with references to preferred embodiments thereof, it will be understood by those skilled in the art that various changes in form and details may be made therein without departing from the scope of the invention encompassed by the appended claims.

What is claimed is:

1. An enteral bag system for containing a nutritional composition, comprising:

front and rear panels which are welded to each other by a bottom weld and a top weld and a left oblique weld and a right oblique weld on each opposed side; and a bag connector fitment, wherein said fitment includes a tamper evident cap with a spike port for filling and dispensing for enteral feeding located near the lower end of the bag system, between the lower end of the left oblique weld and the right oblique weld and just above the center of the bottom weld, sealed to said front panel.

2. The bag system of claim 1, wherein a volumetric region for containing nutritional composition has a frustoconical shape.

3. The bag system of claim 1, wherein internal angles between lower ends of the two oblique welds and the bottom weld is between 100 degrees and 150 degrees.

4. The bag system of claim 1, wherein internal angles between lower ends of the two oblique welds and the bottom weld is less than 135 degrees.

5. The bag system of claim 1, wherein the tamper evident cap is attached to the front panel.

6. The bag system of claim 1, wherein the left oblique weld and the right oblique weld run from the top portions of the left edge weld and the right edge weld, respectively, to the bottom weld at approximately ⅓ the length of the weld from either side.

* * * * *